US011982150B2

(12) United States Patent
Slup et al.

(10) Patent No.: US 11,982,150 B2
(45) Date of Patent: May 14, 2024

(54) DOWNHOLE TOOL AND METHOD OF USE

(71) Applicant: The WellBoss Company, LLC, Houston, TX (US)

(72) Inventors: Gabriel A. Slup, Spring, TX (US); Martin P. Coronado, Fulshear, TX (US); Ryan D. Rasmussen, The Woodlands, TX (US); Chad Michael Erick Gibson, The Woodlands, TX (US)

(73) Assignee: The WellBoss Company, LLC, Houston, TX (US)

( * ) Notice: Subject to any disclaimer, the term of this patent is extended or adjusted under 35 U.S.C. 154(b) by 270 days.

(21) Appl. No.: 17/591,364

(22) Filed: Feb. 2, 2022

(65) Prior Publication Data

US 2022/0243554 A1 Aug. 4, 2022

Related U.S. Application Data

(60) Provisional application No. 63/144,677, filed on Feb. 2, 2021.

(51) Int. Cl.

| | |
|---|---|
| ***E21B 33/12*** | (2006.01) |
| ***E21B 33/124*** | (2006.01) |
| ***E21B 33/128*** | (2006.01) |
| ***E21B 34/14*** | (2006.01) |
| ***E21B 43/26*** | (2006.01) |

(52) U.S. Cl.

CPC ..... *E21B 33/1285* (2013.01); *E21B 33/124* (2013.01); *E21B 34/142* (2020.05); *E21B 43/26* (2013.01); *E21B 2200/02* (2020.05); *E21B 2200/04* (2020.05)

(58) Field of Classification Search

CPC .. E21B 33/1285; E21B 33/124; E21B 34/142; E21B 43/26; E21B 2200/02; E21B 2200/04

See application file for complete search history.

(56) References Cited

U.S. PATENT DOCUMENTS

| | | | |
|---|---|---|---|
| 8,505,632 | B2 | 8/2013 | Guererro et al. |
| 8,839,873 | B2 | 9/2014 | Johnson et al. |
| 8,991,505 | B2 | 3/2015 | Fleckenstein et al. |
| 9,512,695 | B2 | 12/2016 | Pabon et al. |
| 9,650,851 | B2 | 5/2017 | Whitsitt et al. |
| 9,650,867 | B2 | 5/2017 | Pabon et al. |
| 9,765,595 | B2 | 9/2017 | Themig et al. |
| 9,926,773 | B2 | 3/2018 | Hallundbaek et al. |
| 9,938,788 | B2 | 4/2018 | Barbato |
| 10,066,459 | B2 | 9/2018 | Antonsen |
| 10,337,271 | B2 | 7/2019 | Robertson et al. |
| 2006/0124312 | A1 | 6/2006 | Rytlewski |
| 2011/0056692 | A1 | 3/2011 | Lopez de Cardenas et al. |
| 2012/0085538 | A1 | 4/2012 | Guerrero et al. |
| 2012/0168163 | A1 | 7/2012 | Bertoja et al. |
| 2014/0041876 | A1 | 2/2014 | Fleckenstein et al. |

(Continued)

*Primary Examiner* — Christopher J Sebesta

(74) *Attorney, Agent, or Firm* — Kearney, McWilliams & Davis, PLLC; John M. DeBoer

(57) ABSTRACT

A downhole tool suitable for use in a wellbore, the tool having a cone, a first sleeve, and a lower sleeve. The downhole tool includes the first sleeve, or a portion thereof, disposed around one end of the cone. After activation, the lower sleeve is engaged with the first sleeve, leaving a remnant cone-sleeve component configured to plug a restriction.

18 Claims, 5 Drawing Sheets

(56) References Cited

U.S. PATENT DOCUMENTS

| | | | | |
|---|---|---|---|---|
| 2014/0202708 | A1 | 7/2014 | Jacob et al. | |
| 2015/0101825 | A1* | 4/2015 | Jacob | E21B 33/1212 166/376 |
| 2017/0362912 | A1* | 12/2017 | Smith | E21B 33/1291 |
| 2018/0223627 | A1 | 8/2018 | Pabon | |
| 2019/0032444 | A1 | 1/2019 | Provost et al. | |
| 2019/0234175 | A1 | 8/2019 | Crow et al. | |
| 2020/0157914 | A1* | 5/2020 | Graham | E21B 33/128 |
| 2020/0370392 | A1* | 11/2020 | Jordan, Jr. | E21B 33/1216 |

* cited by examiner

DOWNHOLE TOOL AND METHOD OF USE

STATEMENT REGARDING FEDERALLY SPONSORED RESEARCH OR DEVELOPMENT

Not applicable.

BACKGROUND

Field of the Disclosure

This disclosure generally relates to downhole tools and related systems and methods used in oil and gas wellbores. More specifically, the disclosure relates to a downhole system and tool that may be run into a wellbore and useable for wellbore isolation, and methods pertaining to the same. In particular embodiments, the downhole tool may be a plug made of drillable materials. In other embodiments, one or more components may be made of a dissolvable material, any of which may be composite- or metal-based. The downhole tool may be activated or set without having to engage a tubular sidewall.

Background of the Disclosure

An oil or gas well includes a wellbore extending into a subterranean formation at some depth below a surface (e.g., Earth's surface), and is usually lined with a tubular, such as casing, to add strength to the well. Many commercially viable hydrocarbon sources are found in "tight" reservoirs, which means the target hydrocarbon product may not be easily extracted. The surrounding formation (e.g., shale) to these reservoirs typically has low permeability, and it is uneconomical to produce the hydrocarbons (i.e., gas, oil, etc.) in commercial quantities from this formation without the use of drilling accompanied with fracing operations.

Fracing now has a significant presence in the industry, and is commonly understood to include the use of some type of plug set in the wellbore below or beyond the respective target zone, followed by pumping or injecting high pressure frac fluid into the zone. For economic reasons, fracing (and any associated or peripheral operation) is now ultra-competitive, and in order to stay competitive innovation is paramount. A frac plug and accompanying operation may be such as described or otherwise disclosed in U.S. Pat. No. 8,955,605, incorporated by reference herein in its entirety for all purposes.

FIG. 1 illustrates a conventional plugging system 100 that includes use of a downhole tool 102 used for plugging a section of the wellbore 106 drilled into formation 110. The tool or plug 102 may be lowered into the wellbore 106 by way of workstring 112 (e.g., e-line, wireline, coiled tubing, etc.) and/or with setting tool 117, as applicable. The tool 102 generally includes a body 103 with a compressible seal member 122 to seal the tool 102 against an inner surface 107 of a surrounding tubular, such as casing 108. The tool 102 may include the seal member 122 disposed between one or more slips 109, 111 that are used to help retain the tool 102 in place.

In operation, forces (usually axial relative to the wellbore 106) are applied to the slip(s) 109, 111 and the body 103. As the setting sequence progresses, slip 109 moves in relation to the body 103 and slip 111, the seal member 122 is actuated, and the slips 109, 111 are driven against corresponding conical surfaces 104. This movement axially compresses and/or radially expands the compressible member 122, and the slips 109, 111, which results in these components being urged outward from the tool 102 to contact the inner wall 107. In this manner, the tool 102 provides a seal expected to prevent transfer of fluids from one section 113 of the wellbore across or through the tool 102 to another section 115 (or vice versa, etc.), or to the surface. Tool 102 may also include an interior passage (not shown) that allows fluid communication between section 113 and section 115 when desired by the user. Oftentimes multiple sections are isolated by way of one or more additional plugs (e.g., 102A).

The setting tool 117 is incorporated into the workstring 112 along with the downhole tool 102. Examples of commercial setting tools include the Baker #10 and #20, and the 'Owens Go'. Upon proper setting, the plug may be subjected to high or extreme pressure and temperature conditions, which means the plug must be capable of withstanding these conditions without destruction of the plug or the seal formed by the seal element. High temperatures are generally defined as downhole temperatures above 200° F., and high pressures are generally defined as downhole pressures above 7,500 psi, and even in excess of 15,000 psi. Extreme wellbore conditions may also include high and low pH environments. In these conditions, conventional tools, including those with compressible seal elements, may become ineffective from degradation. For example, the sealing element may melt, solidify, or otherwise lose elasticity, resulting in a loss the ability to form a seal barrier.

Before production operations may commence, conventional plugs typically require some kind of removal process, such as milling or drilling. Drilling typically entails drilling through the set plug, but in some instances the plug can be removed from the wellbore essentially intact (i.e., retrieval). A common problem with retrievable plugs is the accumulation of debris on the top of the plug, which may make it difficult or impossible to engage and remove the plug. Such debris accumulation may also adversely affect the relative movement of various parts within the plug. Furthermore, with current retrieving tools, jarring motions or friction against the well casing may cause accidental unlatching of the retrieving tool (resulting in the tools slipping further into the wellbore), or re-locking of the plug (due to activation of the plug anchor elements). Problems such as these often make it necessary to drill out a plug that was intended to be retrievable.

However, because plugs are required to withstand extreme downhole conditions, they are built for durability and toughness, which often makes the drill-through process difficult, time-consuming, and/or require considerable expertise. Even drillable plugs are typically constructed of a metal such as cast iron that may be drilled out with a drill bit at the end of a drill string. Steel may also be used in the structural body of the plug to provide structural strength to set the tool. The more metal parts used in the tool, the longer the drilling operation takes. Because metallic components are harder to drill through, this process may require additional trips into and out of the wellbore to replace worn out drill bits.

Composite materials, such as filament wound materials, have enjoyed success in the frac industry because of easy-to-drill tendencies. The process of making filament wound materials is known in the art, and although subject to differences, typically entails a known process. However, even composite plugs require drilling, or often have one or more pieces of metal (sometimes hardened metal).

The use of plugs in a wellbore is not without other problems. It is naturally desirable to "flow back," i.e., from the formation to the surface, the injected fluid, or the formation fluid(s); however, this is not possible until the previously set tool or its blockage is removed. Removal of tools (or blockage) usually requires a well-intervention service for retrieval or drill-through, which is time consuming, costly, and adds a potential risk of wellbore damage.

The more metal parts used in the tool, the longer the drill-through operation takes. Because metallic components are harder to drill, such an operation may require additional trips into and out of the wellbore to replace worn out drill bits.

In the interest of cost-saving, materials that react under certain downhole conditions have been the subject of significant research in view of the potential offered to the oilfield industry. For example, such an advanced material that has an ability to degrade by mere response to a change in its surrounding is desirable because no, or limited, intervention would be necessary for removal or actuation to occur.

Such a material, essentially self-actuated by changes in its surrounding (e.g., the presence a specific fluid, a change in temperature, and/or a change in pressure, etc.) may potentially replace costly and complicated designs and may be most advantageous in situations where accessibility is limited or even considered to be impossible, which is the case in a downhole (subterranean) environment. However, these materials tend to be exotic, rendering related tools made of such materials undesirable as a result of high cost.

Conventional, and even modern, tools require an amount of materials and components that still result in a set tool being in excess of twelve inches. A shorter tool means less materials, less parts, reduced removal time, and easier to deploy.

The ability to save cost on materials and/or operational time (and those saving operational costs) leads to considerable competition in the marketplace. Achieving any ability to save time, or ultimately cost, leads to an immediate competitive advantage.

Frac plugs offered on the market currently are conventional in design, incorporating the aforementioned slips and sealing elements of some kind. This generally requires a number of parts that must be removed after the frac operation is compete, such as dissolving or drilling. The larger the volume of material to dissolve or drill correlates to the total amount of time involved in removal.

Also, some operators are growing weary of casing damage caused by conventional slips when they penetrate the casing when anchoring.

Accordingly, there are needs in the art for novel systems and methods for isolating wellbores in a fast, viable, and economical fashion. There is a great need in the art for downhole plugging tools that contain less materials, less parts, have reduced or eliminated removal time, and are easier to deploy, even in the presence of extreme wellbore conditions. There is also a need for a downhole tool made substantially of a drillable material that is easier and faster to drill, or outright eliminates a need for drill-thru.

A simpler design, with fewer parts, will have a competitive advantage. Using less material also translates into lower production cost, since the dissolving material cost is a greater percentage of the overall cost when compared to conventional composite plugs. A tool with fewer parts is cost effective, which is of greater significance in a depressed market. Embodiments herein provide for a downhole tool that is void of a slip, and thus casing damage that might otherwise occur from slip engagement is totally mitigated.

SUMMARY

Embodiments of the disclosure pertain to a downhole tool, or method of using the same, wherein at least one component of the downhole tool may be made of a dissolvable material. In operation, activation of the downhole tool in the wellbore results in expansion of a sleeve, but the downhole tool need not be anchored to a surround tubular. After activation, a lower sleeve may break away, and a remnant cone-sleeve component engaged together may be configured to move or be moved to seat on a pre-existing restriction, and thereby form a plug in support of a fracturing operation once a ball or other plug device may be seated in the cone.

Other embodiments herein pertain to a downhole tool for use in a wellbore that may include one or more of the following: a cone; an expansion or first sleeve or ring slidingly engaged with the distal end; and a lower sleeve coupled with the sleeve or ring.

The cone may include a distal end; a proximate end; and an outer surface.

At least one component of the downhole tool may be made of a dissolvable material. Activation of the downhole tool in the wellbore may result in expansion of the sleeve or ring, but the tool need not be anchored wherein after activation, the lower sleeve breaks away, and the cone and expansion sleeve engaged together are configured to move or be moved to seat on a pre-existing restriction, and thereby form a plug in support of a fracturing operation once a ball is seated in the cone.

The downhole tool may have an inner flowbore. The inner flowbore may be associated with the cone. The flowbore may have an inner diameter in a bore range of any suitable size. In aspects, the range may be of at least 1 inch to no more than 5 inches.

The lower sleeve may include a shear tab. In aspects, the lower sleeve does not directly contact the cone.

Yet other embodiments of the disclosure pertain to a downhole setting system for use in a wellbore that may include one or more of: a workstring; a setting tool assembly coupled to the workstring; and a downhole tool.

The setting tool assembly may include a tension mandrel. The tension mandrel may have a first tension mandrel end and a second tension mandrel end. The assembly may include a setting sleeve.

The downhole tool may include a cone. The cone may have a distal end; a proximate end; and an outer surface. Prior to activation, the tool may include a ring or sleeve component engaged with the distal end. There may be a lower sleeve coupled with the tension mandrel.

The tension mandrel may be disposed through the downhole tool. There may be a nose nut engaged with each of the second tension mandrel end and the lower sleeve. There may be at least one component of the downhole tool made of a dissolvable material.

Activation of the downhole tool in the wellbore may result in expansion of the sleeve, but the tool is not anchored against a side of a casing string.

In aspects, a surrounding tubular in the wellbore may include a restriction sub or insert ring between joints or connections. The side of the tubular may include a side inner diameter. The restriction sub may include a profile having a restriction inner diameter. The side inner diameter may be larger than the restriction inner diameter.

After activation, the remnant downhole tool may be configured to move or be moved to seat on the profile, and thereby form a plug in support of a fracturing operation once a ball or other obstruction is seated in the downhole tool.

The lower sleeve may include a shear tab. The lower sleeve need not be in direct contact with the cone. The lower sleeve may fall way from the sleeve or ring, leaving a remnant sleeve-ring. The lower sleeve may not fall away from the lower sleeve, and thus be engaged in a setting configuration.

The cone may have a ball seat formed within an inner flowbore.

In aspects, the sleeve or ring, along with the cone, 'shoulder out' once the sleeve or ring is diametrically fully expanded.

A downhole tool, system, or method of use that may include: a plug made from a dissolvable material that may be expanded in the casing (but not anchored), and then moves downhole to seat on a pre-existing casing restriction, which then forms a temporary plug in a surrounding tubular suitable for a completion operation, particularly once a ball or comparable obstruction becomes seated in the plug.

Other embodiments of the disclosure pertain to a downhole tool for use in a wellbore that may include any of a cone having a distal end; a proximate end; and an outer surface, an expansion sleeve slidingly engaged with the outer surface; and a lower sleeve proximate with the expansion sleeve.

In a run-in configuration or position, the cone need not be engaged with the lower sleeve. In aspects, after setting or moving the downhole tool to a set configuration or position, the cone may be engaged with the lower sleeve. At least one component of the downhole tool may be made of a dissolvable material. Setting of the downhole tool may result in expansion of the expansion sleeve. However, the downhole tool may remains free to move or be moved to seat on a pre-existing restriction, and thereby form a plug in support of a fracturing operation (such as once a ball is seated in the cone).

Still other embodiments of the disclosure pertain to a method of using a downhole tool in a wellbore, the method may include any of the steps of: running the downhole tool in a run-in configuration to a position within a tubular disposed within the wellbore; activating or causing a setting tool assembly to move the downhole tool from the run-in configuration to a set configuration; and causing or operating the setting assembly whereby the downhole tool and the setting tool assembly disconnect from each other.

The downhole tool may include a cone; an expansion sleeve slidingly engaged with the cone; and a lower sleeve proximate with the expansion sleeve. In the set configuration, the downhole tool need not be anchored against the tubular. In aspects, at least one component of the downhole tool is made of a dissolvable material. In other aspects, each of the cone and the lower sleeve are made of dissolvable material.

Activation of the downhole tool via setting may result in expansion of the expansion sleeve, wherein the downhole tool in the set configuration is configured to move or be moved to seat on a pre-existing restriction. This may result in the forming of a plug in support of a fracturing operation (which may be once a ball is seated in the cone).

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein.

DETAILED DESCRIPTION

Figure 1:
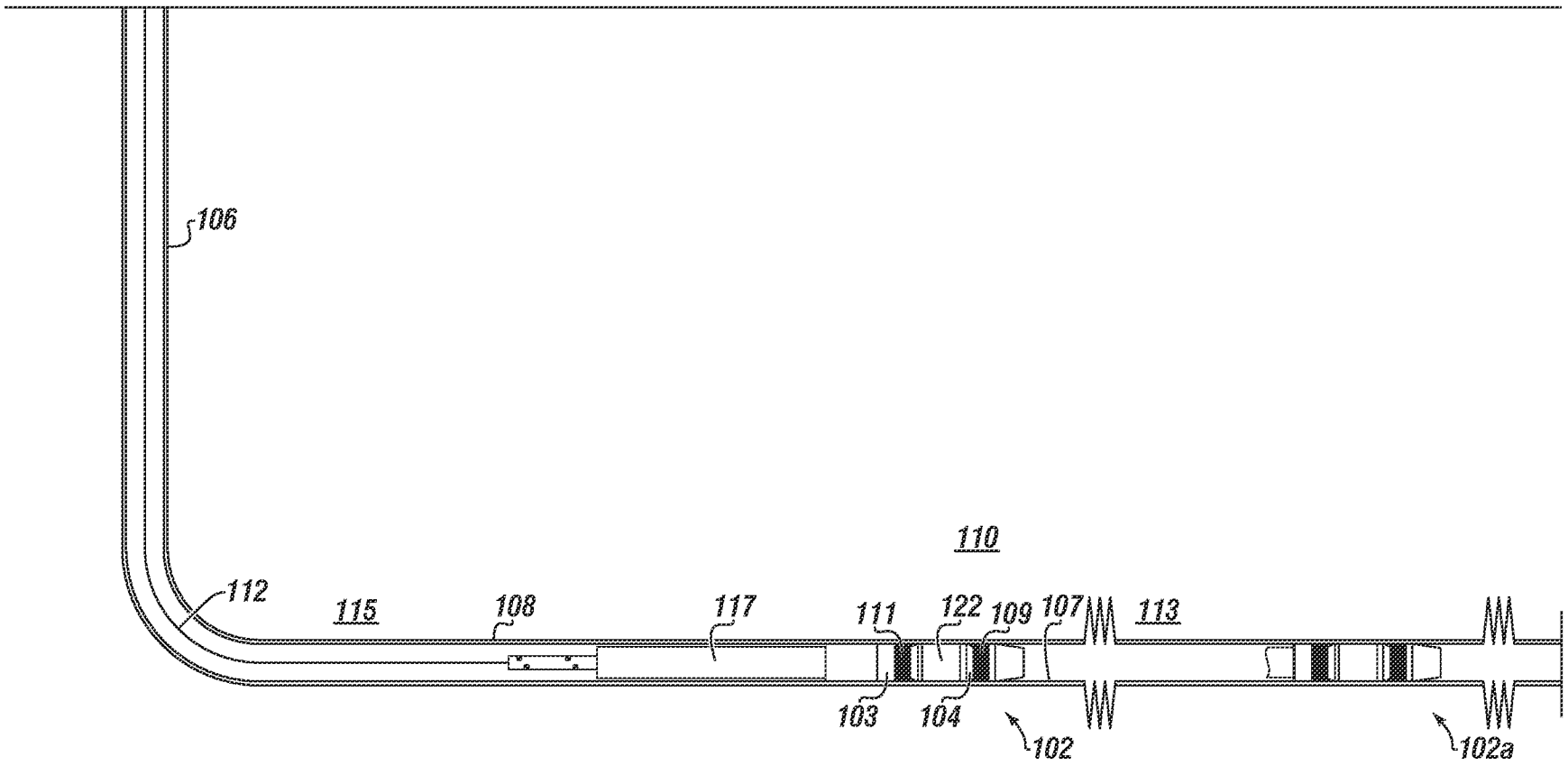
FIGURE 1 (PRIOR ART)
FIG. 1 is a side view of a process diagram of a conventional plugging system.

Herein disclosed are novel apparatuses, systems, and methods that pertain to and are usable for wellbore operations, details of which are described herein.

Embodiments of the present disclosure are described in detail in a non-limiting manner with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," "right", "left", "down", etc., are used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional sealing materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components that may be new, used, and/or retrofitted.

Various equipment may be in fluid communication directly or indirectly with other equipment. Fluid communication may occur via one or more transfer lines and respective connectors, couplings, valving, and so forth. Fluid movers, such as pumps, may be utilized as would be apparent to one of skill in the art.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, temperature, pressure, distance, melt index, etc., is from 100 to 1,000, it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure. Others may be implied or inferred.

Embodiments herein may be described at the macro level, especially from an ornamental or visual appearance. Thus, a dimension, such as length, may be described as having a certain numerical unit, albeit with or without attribution of a particular significant figure. One of skill in the art would appreciate that the dimension of "2 centimeters" may not be exactly 2 centimeters, and that at the micro-level may deviate. Similarly, reference to a "uniform" dimension, such as thickness, need not refer to completely, exactly uniform. Thus, a uniform or equal thickness of "1 millimeter" may have discernable variation at the micro-level within a certain tolerance (e.g., 0.001 millimeter) related to imprecision in measuring and fabrication. Embodiments depicted in drawings need not be to scale.

Terms

The term "connected" as used herein may refer to a connection between a respective component (or subcomponent) and another component (or another subcomponent), which can be fixed, movable, direct, indirect, and analogous to engaged, coupled, disposed, etc., and can be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "fluid" as used herein may refer to a liquid, gas, slurry, multi-phase, etc. and is not limited to any particular type of fluid such as hydrocarbons.

The term "fluid connection", "fluid communication," "fluidly communicable," and the like, as used herein may refer to two or more components, systems, etc. being coupled whereby fluid from one may flow or otherwise be transferrable to the other. The coupling may be direct or indirect. For example, valves, flow meters, pumps, mixing tanks, holding tanks, tubulars, separation systems, and the like may be disposed between two or more components that are in fluid communication.

The term "pipe", "conduit", "line", "tubular", or the like as used herein may refer to any fluid transmission means, and may be tubular in nature.

The term "composition" or "composition of matter" as used herein may refer to one or more ingredients, components, constituents, etc. that make up a material (or material of construction). Composition may refer to a flow stream, or the material of construction of a component of a downhole tool, of one or more chemical components.

The term "chemical" as used herein may analogously mean or be interchangeable to material, chemical material, ingredient, component, chemical component, element, substance, compound, chemical compound, molecule(s), constituent, and so forth and vice versa. Any 'chemical' discussed in the present disclosure need not refer to a 100% pure chemical. For example, although 'water' may be thought of as H2O, one of skill would appreciate various ions, salts, minerals, impurities, and other substances (including at the ppb level) may be present in 'water'. A chemical may include all isomeric forms and vice versa (for example, "hexane", includes all isomers of hexane individually or collectively).

The term "pump" as used herein may refer to a mechanical device suitable to use an action such as suction or pressure to raise or move liquids, compress gases, and so forth. 'Pump' can further refer to or include all necessary subcomponents operable together, such as impeller (or vanes, etc.), housing, drive shaft, bearings, etc. Although not always the case, 'pump' can further include reference to a driver, such as an engine and drive shaft. Types of pumps include gas powered, hydraulic, pneumatic, and electrical.

The term "frac operation" as used herein may refer to fractionation of a downhole well that has already been drilled. 'Frac operation' can also be referred to and interchangeable with the terms fractionation, hydrofracturing, hydrofracking, fracking, fracing, frac, and the like. A frac operation can be land or water based.

The term "mounted" as used herein may refer to a connection between a respective component (or subcomponent) and another component (or another subcomponent), which can be fixed, movable, direct, indirect, and analogous to engaged, coupled, disposed, etc., and can be by screw, nut/bolt, weld, and so forth.

The term "reactive material" as used herein may refer a material with a composition of matter having properties and/or characteristics that result in the material responding to a change over time and/or under certain conditions. The term reactive material may encompass degradable, dissolvable, disassociatable, dissociable, and so on.

The term "degradable material" as used herein may refer to a composition of matter having properties and/or characteristics that, while subject to change over time and/or under certain conditions, lead to a change in the integrity of the material. As one example, the material may initially be hard, rigid, and strong at ambient or surface conditions, but over time (such as within about 12-36 hours) and under certain conditions (such as wellbore conditions), the material softens.

The term "dissolvable material" may be analogous to degradable material. The term as used herein may refer to a composition of matter having properties and/or characteristics that, while subject to change over time and/or under certain conditions, lead to a change in the integrity of the material, including to the point of degrading, or partial or complete dissolution. As one example, the material may initially be hard, rigid, and strong at ambient or surface conditions, but over time (such as within about 12-36 hours) and under certain conditions (such as wellbore conditions), the material softens. As another example, the material may initially be hard, rigid, and strong at ambient or surface conditions, but over time (such as within about 12-36 hours) and under certain conditions (such as wellbore conditions), the material dissolves at least partially, and may dissolve completely. The material may dissolve via one or more mechanisms, such as oxidation, reduction, deterioration, go into solution, or otherwise lose sufficient mass and structural integrity.

The term "breakable material" as used herein may refer to a composition of matter having properties and/or characteristics that, while subject to change over time and/or under certain conditions, lead to brittleness. As one example, the material may be hard, rigid, and strong at ambient or surface conditions, but over time and under certain conditions, becomes brittle. The breakable material may experience breakage into multiple pieces, but not necessarily dissolution.

For some embodiments, a material of construction may include a composition of matter designed or otherwise having the inherent characteristic to react or change integrity or other physical attribute when exposed to certain wellbore conditions, such as a change in time, temperature, water, heat, pressure, solution, combinations thereof, etc. Heat may be present due to the temperature increase attributed to the natural temperature gradient of the earth, and water may already be present in existing wellbore fluids. The change in integrity may occur in a predetermined time period, which may vary from several minutes to several weeks. In aspects, the time period may be about 12 to about 36 hours.

The term "machined" can refer to a computer numerical control (CNC) process whereby a robot or machinist runs computer-operated equipment to create machine parts, tools and the like.

Figure 2:
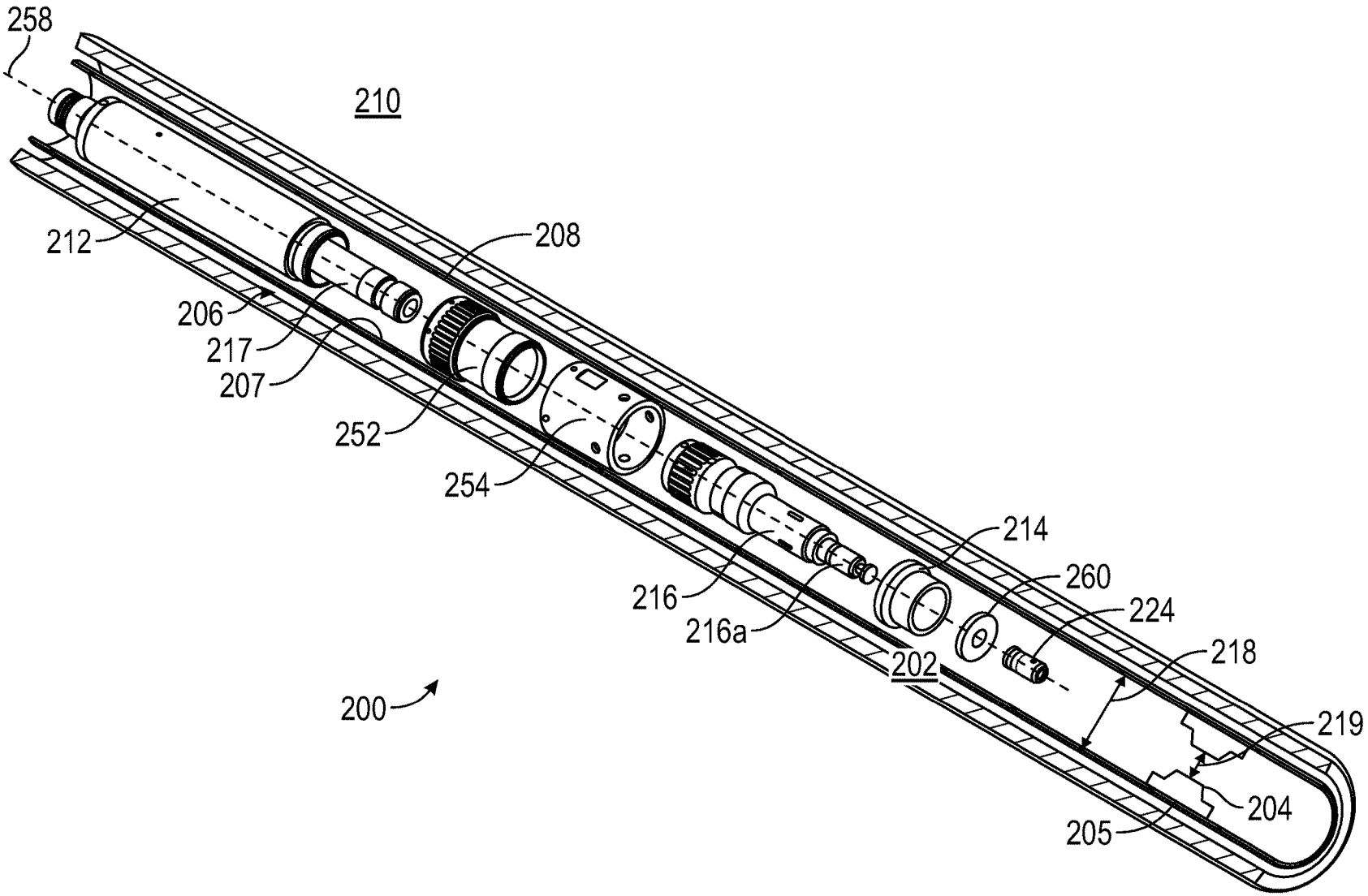
FIG. 2 shows an isometric view of a system having a downhole tool, according to embodiments of the disclosure.

Referring now to FIG. 2, an isometric view of a system 200 having a downhole tool 202 illustrative of embodiments disclosed herein, are shown. FIG. 2 depicts a wellbore 206 formed in a subterranean formation 210 with a tubular 208 disposed therein. In an embodiment, the tubular 208 may be casing (e.g., casing, hung casing, casing string, etc.) (which may be cemented), and the like. The tubular 208 may be configured with a restriction sub or profile 205.

A workstring 212 (which may include a setting tool [or a part 217 of a setting tool] configured with an adapter 252) may be used to position or run the downhole tool 202 into and through the wellbore 206 to a desired location. One of skill would appreciate the setting tool may be like that provided by Baker or Owen. The setting tool assembly 217 may include or be associated with a setting sleeve 254. The setting sleeve 254 may be engaged with the downhole tool (or a component thereof) 202.

The setting tool may include a tension mandrel 216 associated (e.g., coupled) with an adapter 252. In an embodiment, the adapter 252 may be coupled with the setting tool (or part thereof) 217, and the tension mandrel 216 may be coupled with tool 217. The coupling may be a threaded connection (such as via threads on 217 and corresponding threads of the tension mandrel 216—not shown here). The tension mandrel 216 may extend, at least partially, out of the (bottom/downhole/distal end) tool 202.

An end or extension 216*a* of the tension mandrel 216 may be coupled with a nose sleeve or nut 224. The nut 224 may have a threaded connection with the end 216*a* (and thus corresponding mating threads), although other forms of coupling may be possible. For additional securing, one or more set screws (FIG. 3, 326) may be disposed through set screw holes (327) and screwed into or tightened against the end 216*a*. The nut 224 may engage or abut against a shear tab of a lower sleeve 260.

The downhole tool 202, as well as its components, may be annular in nature, and thus centrally disposed or arranged with respect to a longitudinal axis 258. In accordance with embodiments of the disclosure, the tool 202 may be configured as a plugging tool, which may be set within the tubular 208, albeit not in the traditional sense of a plugging tool.

That is, instead of the tool 202 being set in a manner whereby the tool 202 expands to engage the casing, the tool 202 may be activated, but not to the point of engagement with the surrounding tubular surface 207. As shown here, the restriction sub 205 may be configured with an extension or profile 204 that is tantamount to a narrowing of the tubular 208. For example, the tubular 208 may have a tubular inner diameter 218, whereas the profile has a profile inner diameter 219. The profile inner diameter 219 may be smaller than the tubular inner diameter 218, and thus provide the narrowance or smaller passageway. The profile inner diameter 219 is not shown to scale here. In some embodiments, the workstring 212 may be moved through the profile 204, whereby the tool 202 is activated once passed. The tool 202 may then be free to move toward a further or another restriction sub thereafter (not shown here).

In an embodiment, the downhole tool 202 may be configured to provide a plug, whereby flow from one section of the wellbore to another (e.g., above and below the tool 202) is controlled. In other embodiments, once a ball or other obstruction is seated in the tool 202, flow into one section of the wellbore 206 may be blocked and otherwise diverted into the surrounding formation or reservoir 210.

Once the tool 202 reaches the activated position within the tubular 208, the setting mechanism or workstring 212 may be detached from the tool 202 by various methods, resulting in the tool 202 left freely afloat in the surrounding tubular 208.

In an embodiment, once the tool 202 is in the desired position, tension may be applied to the setting tool (217) until a shearable connection between the tool 202 and the workstring 212 is broken. However, the downhole tool 202 may have other forms of disconnect. The amount of load applied to the setting tool and the shearable connection may be in the range of about, for example, 20,000 to 55,000 pounds force.

In embodiments the tension mandrel 216 may separate or detach from a lower sleeve 260 (directly or indirectly)), resulting in the workstring 212 being able to separate from the tool 202, which may be at a predetermined moment. The loads provided herein are non-limiting and are merely exemplary. The setting force may be determined by specifically designing the interacting surfaces of the tool 202 and the respective tool surface angles.

Operation of the downhole tool 202 may allow for fast run in of the tool 202 to isolate one or more sections of the wellbore 206, as well as quick and simple drill-through or dissolution to destroy or remove the tool 202.

Accordingly, in some embodiments, drill-through may be completely unnecessary. As such the downhole tool 202 may have one or more components made of a reactive material, such as a metal or metal alloys. The downhole tool 202 may have one or more components made of a reactive material (e.g., dissolvable, degradable, etc.), which may be plastic, composite- or metal-based.

It follows then that one or more components of a tool of embodiments disclosed herein may be made of reactive materials (e.g., materials suitable for and are known to dissolve, degrade, etc. in downhole environments [including extreme pressure, temperature, fluid properties, etc.] after a brief or limited period of time (predetermined or otherwise) as may be desired). In an embodiment, a component made of a reactive material may begin to react at first contact with the dissolving fluid, and remain viable about 3 to about 48 hours after setting of the downhole tool 202.

In embodiments, one or more components may be made of a metallic material, such as an aluminum-based or magnesium-based material. The metallic material may be reactive, such as dissolvable, which is to say under certain conditions the respective component(s) may begin to dissolve, and thus alleviating the need for drill thru. These conditions may be anticipated and thus predetermined. In embodiments, the components of the tool 202 may be made of dissolvable aluminum-, magnesium-, or aluminum-magnesium-based (or alloy, complex, etc.) material, such as that provided by Nanjing Highsur Composite Materials Technology Co. LTD or Terves, Inc.

One or more components of tool 202 may be made of non-dissolvable materials (e.g., materials suitable for and are known to withstand downhole environments [including extreme pressure, temperature, fluid properties, etc.] for an extended period of time (predetermined or otherwise) as may be desired).

The downhole tool 202 (and other tool embodiments disclosed herein) and/or one or more of its components may be 3D-printed or made with other forms of additive manufacturing.

Figure 3A:
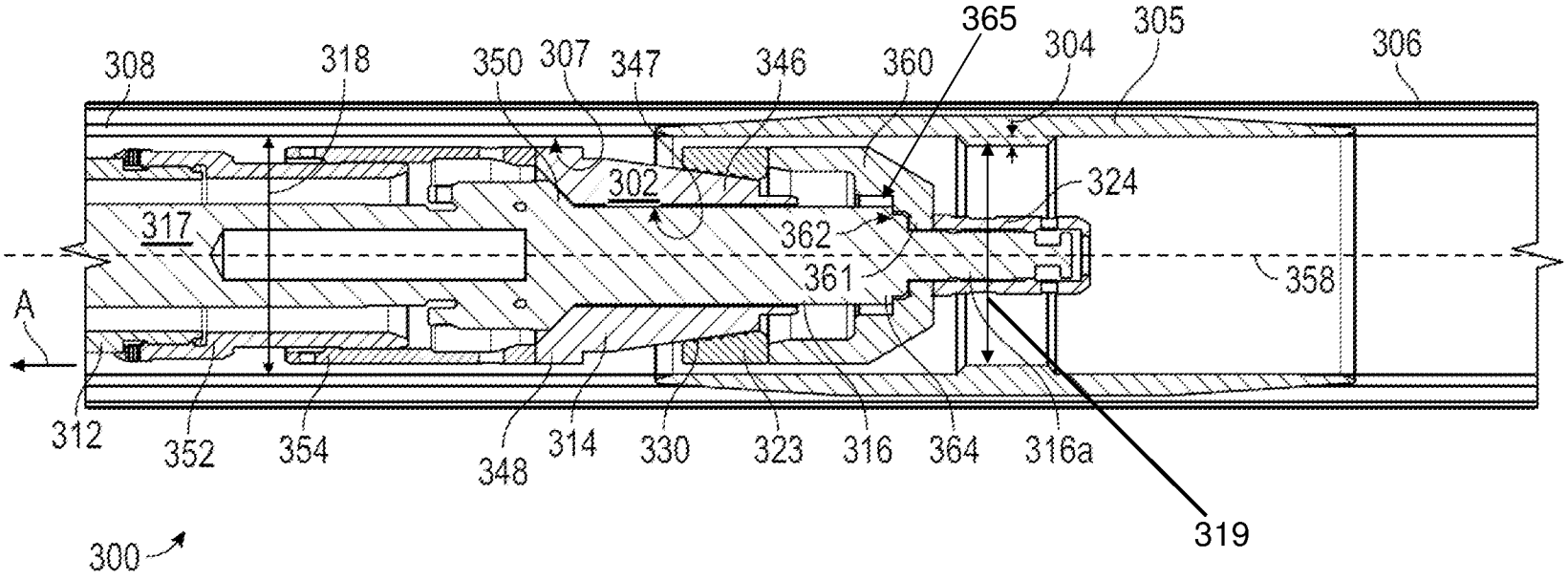
FIG. 3A shows a longitudinal side cross-sectional view of a system having an unset downhole tool, according to embodiments of the disclosure.
Figure 3B:
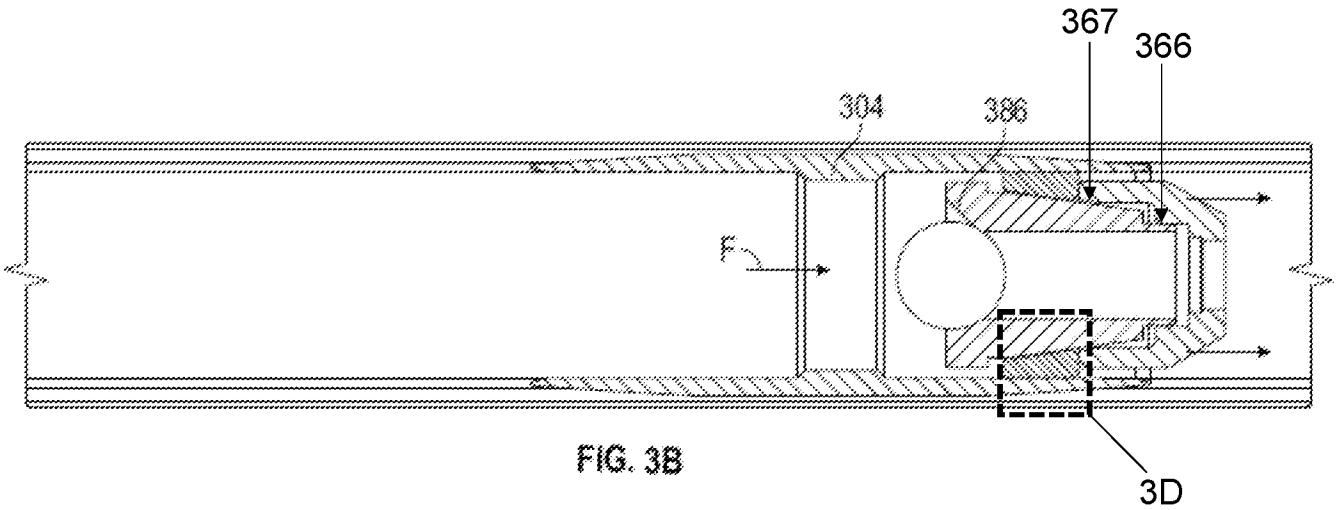
FIG. 3B shows a longitudinal side cross-sectional view of the system of FIG. 3A with the downhole tool in a set position, according to embodiments of the disclosure.
Figure 3C:
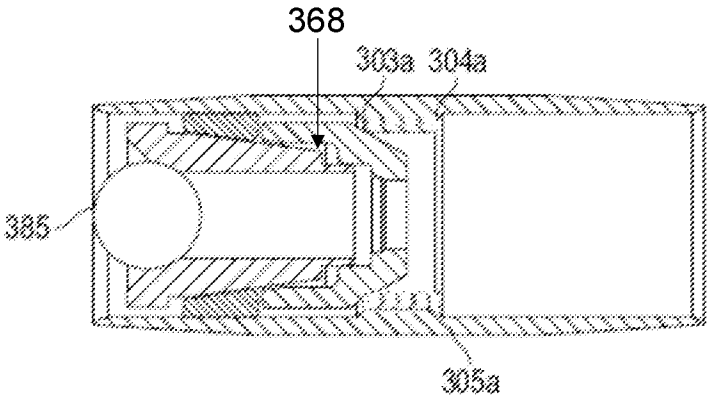
FIG. 3C shows a longitudinal side cross-sectional view of the tool of FIG. 3B engaged into a restriction sub, according to embodiments of the disclosure.

Referring now to FIGS. 3A, 3B, 3C together, and 3D together, a longitudinal side cross-sectional view of a system having an unset downhole tool, a longitudinal side cross-sectional view of the downhole tool of FIG. 3A in a disconnected position, a longitudinal side cross-sectional view of the downhole tool of FIG. 3B urged against a restriction sub, and a close-up sectional view of an expansion sleeve, according to embodiments of the disclosure, are shown. One of skill would appreciate the views of FIGS. 3A-3C may be partial in nature. The setting device(s) and components of the downhole tool 302 may be coupled with, and axially and/or longitudinally movable, at least partially, with respect to each other.

Embodiments herein provide for a downhole tool that may have as few as three basic parts, plus a dissolvable ball. An expanding sleeve may be machined to an OD which easily passes through a restriction(s) in the wellbore, of which the restriction may be configured to provide a seat for the tool. When at setting depth (which may be predetermined), the expandable sleeve may be expanded in diameter larger than the restriction diameters in the surrounding tubular (e.g., casing string).

This may occur by urging a cone member into the sleeve, such as via the use of a wireline setting tool, until the two parts locate on corresponding shoulders in both parts. Once expanded, the sleeve and cone may be locked together via friction, press- or interference-fit, or comparable. These parts may be secured to the setting tool with a lower sleeve, which may be configured as a shear ring. Once adequate force is generated to shear the lower sleeve, the downhole tool (and its components) may be released from the setting tool. The setting tool may then be retrieved from the well after firing perforating guns run above the setting tool. The downhole tool, in the expanded condition, need not (sealingly or securingly) engage the tubular ID, and instead may be free floating therein.

Other embodiments herein pertain to a downhole tool that may include an expandable sleeve or ring (such as a seal ring), which may be urged or otherwise driven up or against a cone member (or outer conical surface) during setting. This may provide the interference with the restriction sub. Releasing from the setting tool may be comparable to other embodiments described herein. The length of the expandable sleeve or ring may dictate how much differential pressure the tool can withstand. The outer cone surface (or 'ramp angle') may dictate the setting force required to fully expand the sleeve.

Once wireline is out of the hole, a dissolvable ball or other type of obstruction may be pumped to its seat in the tool (any embodiment), and may push the tool downhole until downhole tool lands on the next lower restriction sub in the well. The tool may seat on the restriction forming a pressure barrier for the subsequent frac job. Restriction subs may be installed in the tubular string when the tubular is run.

Advantageously, a downhole tool embodiment of the present disclosure need not anchor to the surrounding tubular, such as with traditional plugs—thus there is no damage to the tubular from hardened slip teeth or buttons. The tool location during the fracturing operation may be defined by the location of the restriction subs run in the tubular string.

Once expanded using the setting tool, and then disconnected, the downhole tool may be akin to a plug/ball, and may seats on the next lower restriction sub in the wellbore. The interface geometry between the cone/expansion sleeve/ring may be configured to allow expansion to the desired outer diameter while staying within the operational force output of the setting tool (e.g., 55,000 lbf. for the size 20 tool). The end of the cone may be rounded to provide the ultimate contact area with the sleeve. Having a slightly recessed diameter behind the ball may prevent friction from the previously expanded section of the sleeve, thus preventing accumulation of force as the entire length of the sleeve expands. The downhole tool may be configured with a ramp angle between the cone and expandable sleeve to control setting force. Having the sleeve/ring bottom-out on the external upset in the cone may put the sleeve/ring material in compression when pressuring against the tool from above, which may reduce shear stress in the material.

Embodiments herein may pertain to a downhole system 300 that includes a wellbore 308 having a tubular (such as a casing string or the like) 306 disposed therein. A workstring 312 (shown only in part here) may be used to run a downhole tool 302 into the tubular 306 to a desired position.

The downhole tool 302 may include a cone (or conical shaped member) 314 that extends through the tool 302 (or tool body). The cone 314 may have one or more 'conical' (frustoconical, etc.) surfaces 330 (e.g., a surface off-axis to long axis 358). The cone 314 may include a flowpath or bore 350 formed therein (e.g., an axial bore). The bore 350 may extend partially or for a short distance through the cone 314. Alternatively, the bore 350 may extend through the entire cone 314, with an opening at its proximate end 348 and oppositely at its distal end 346 (near downhole or bottom end of the tool 302).

The presence of the bore 350 or other flowpath through the cone 314 may indirectly be dictated by operating conditions. That is, in most instances the tool 302 may be large enough in diameter (e.g., 4¾ inches) that the bore 350 may be correspondingly large enough (e.g., 1¼ inches) so that debris and junk may pass or flow through the bore 350 without plugging concerns. Diameters greater than 4¾ inches and less than 1¼ inches may be used in certain instances, where desired.

With the presence of the bore 350, the cone 314 may have an inner bore surface 347, which may be smooth and annular in nature. In cross-section, the bore surface 347 may be planar. In embodiments, the bore surface 347 (in cross-section) may be parallel to the (central) tool axis 358. As mentioned, the outer cone surface 330 may have one or more surfaces (in cross-section) offset or angled to the tool axis 358.

The bore 350 (and thus the tool 302) may be configured for part of a setting tool assembly 317 (shown only in part here) to fit therein, such as a tension mandrel 316. Thus, the tension mandrel 316, which may be contemplated as being part of the setting tool assembly 317, may be configured for the downhole tool 302 (or components thereof) to be disposed therearound (such as during run-in). In assembly, the downhole tool 302 may be coupled with the setting tool assembly 317 (and around, at least in part, the tension mandrel 316), but need not be in a threaded manner. In an embodiment, the downhole tool 302 (by itself, and not including setting tool components) may be completely devoid of threaded connections. If used, an adapter 352 may include threads thereon. Such threads (not shown here) may correspond to mate with threads of the setting sleeve 354.

As shown, a lower sleeve 360 may be configured with a shear point, such as the shear tab 361. The shear tab 361 may be engaged with the setting tool assembly 317. As shown, the shear tab 361 may be engaged or proximate to each of the tension mandrel 316 and a nose nut 324. The lower sleeve 360 (or the shear point) may be configured to facilitate or promote deforming, and ultimately shearing/breaking, during setting. As such, the shear tab 361 may have at least one recess region or fracture groove 362 (tantamount to a predetermined and purposeful failure point of the lower sleeve 360).

The groove 362 may be circumferential around the tab 361. In embodiments the recess region/groove 362 may be in the form of a v-notch or other shape or configuration suitable to allow the tab 361 to break free from the lower sleeve 360. The shear tab 361 may be configured to shear at a predetermined point. The shear tab 361 may be disposed within an inner lower sleeve bore 364, and protrude (or extend) radially inward in a circumferential manner. There may be other recessed regions.

During setting, as the tension mandrel 316 (and thus tension mandrel end 316*a*) continues to be pulled in direction A, the nut 324 may continue to exert force on the shear tab 361, ultimately resulting in shearing the tab 361. The shear tab 361 may be configured to shear at a load greater than the load for setting the tool 302. Once sheared, the lower sleeve 360 may fall away from the tool 302; however, in the now-expanded state in a position beyond first profile 304, the tool 302 may not fall any further than respective profile 304*a* of a lower restriction sub 305*a* (as illustrated in FIG. 3C). However, the lower sleeve 360 may be configured for an interference fit with the cone 314, such that these components remain engaged with each other, as depicted in FIGS. 3B-3C.

The downhole tool 302 may be run into wellbore 306 to a desired depth or position by way of the workstring (shown in part) that may be configured with the setting tool assembly 317. The workstring and setting tool 317 may be part of the tool system 300 utilized to run the downhole tool 302 into the wellbore and activate the tool 302 to move from an unset to set position. The set or activated position of the tool 302 may include components of the tool 302 compressed together, but the tool 302 is not set or engaged against the tubular 308 (which may be defined by a casing inner diameter 318 of an inner tubular surface 307. Instead, the tool 302 may free float (i.e., move freely) unless and until it may be urged into engagement with a shoulder 303*a* of profile 304*a* (see 3C). The profile 304, 304*a* may have an inner profile diameter 319, 319*a*, respectively. The tubular 308 may be run in the wellbore with one or more restriction profiles disposed therewith.

The setting device(s) and components of the downhole tool 302 may be coupled with, and axially and/or longitudinally movable along or in a working relationship with the cone 314. When the setting sequence begins, the lower sleeve 360 may be pulled via tension mandrel 316 while the setting sleeve 354 remains stationary.

As the tension mandrel 316 is pulled in the direction of Arrow A, one or more the components may begin to compress against one another as a result of the setting sleeve 354 (or end its end) held in place against an end surface of the proximate end 348 of the cone 314.

This force and resultant movement may urge an expansion sleeve or ring 323 to compressively slide against an upper cone surface 330 of the cone 314, and ultimately expand. Thus, the expansion ring 323 may be slidingly engaged with the cone mandrel 314.

As the lower sleeve 360 is pulled further in the direction of Arrow A, the lower sleeve 360 (being engaged with the expansion sleeve 323) may urge the 323 to compressively slide against the cone surface 330. As expansion occurs, the sleeve 323 may move radially outward, but will not expand into engagement with the surrounding tubular 308; at least not the degree that the tool 302 may not move.

In an embodiment, the cone 314 may be configured with a ball seat 386 formed or removably disposed therein. In some embodiments, the ball seat 386 may be integrally formed within the bore 350 of the cone 314. In other embodiments, the ball seat 386 may be separately or optionally installed within the cone 314, as may be desired.

The ball seat 386 may be configured in a manner so that a ball 385 or other form of plug/obstruction may seat or rest therein, whereby the flowpath through the cone 314 may be closed off (e.g., flow through the bore 350 is restricted or controlled by the presence of the ball). In this respect, once the setting tool 317 and the workstring 312 are disconnected from the tool 302, the ball 385 may be free to seat thereagainst.

For example, fluid flow from one direction may urge and hold the ball 385 against the seat 386, whereas fluid flow from the opposite direction may urge the ball 385 off or away from the seat 386. As such, the ball may 385 be used to prevent or otherwise control fluid flow through the tool 302. The ball 385 may be conventionally made of a composite material, dissolvable material, phenolic resin, etc., whereby the ball may be capable of holding maximum pressures experienced during downhole operations (e.g., fracing).

While not limited, a diameter of the ball 385 may be in in a ball diameter range of about 1 inch to about 5 inches. The bore 350 may have an inner bore diameter in a bore diameter range of about 1 inch to about 5 inches. As such, the cone 314 may have suitable wall thickness to handle load and prevent collapse.

The ball 385 may be any type of ball apparent to one of skill in the art and suitable for use with embodiments disclosed herein, including any such ball may be a ball held in place or otherwise positioned within a downhole tool. The ball may be tethered to the tool 302, such as provided for in U.S. Non-Provisional patent application Ser. No. 16/387,985, filed Apr. 18, 2019, and incorporated herein by reference in its entirety for all purposes, including as it pertains to a tethered ball.

The ball 385 may be a "smart" ball (not shown here) configured to monitor or measure downhole conditions, and otherwise convey information back to the surface or an operator, such as the ball(s) provided by Aquanetus Technology, Inc. or OpenField Technology In other aspects, the ball may be made from a composite or dissolvable material. Other materials are possible, such as glass or carbon fibers, phenolic material, plastics, fiberglass composite (sheets), plastic, etc.

The ball 385 may be configured or otherwise designed to dissolve under certain conditions or various parameters, including those related to temperature, pressure, and composition.

Although not shown here, the downhole tool 302 may have a pumpdown ring or other suitable structure to facilitate or enhance run-in. The downhole tool 302 may have a 'composite member' like that described in U.S. Pat. No. 8,955,605, incorporated by reference herein in its entirety for all purposes, particularly as it pertains to the composite member.

FIG. 3A shows the downhole tool 302 in the run-in configuration may have a first clearance 365 formed between the lower sleeve 360 and the tension mandrel 316 and/or cone 314. FIGS. 3B and 3C show the first clearance 365 removed as a result of first contact point 366 between the cone 314 and the lower sleeve 360 when the downhole tool is moved to the set configuration. In the set configuration, there may be a second clearance 368 that is formed between first contact point 366 and a second contact point 367.

Figure 3D:
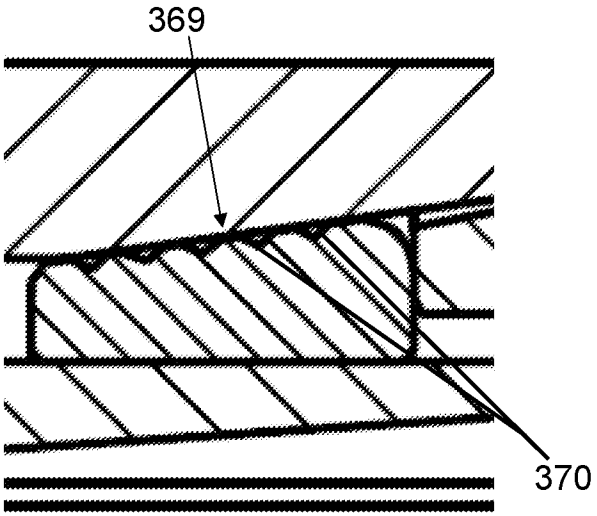
FIG. 3D shows a close-up side cross-sectional view of an expanding ring or sleeve of the tool of FIG. 3B, according to embodiments of the disclosure.

Referring briefly to FIG. 3D, the expansion ring 323 may have an inner ring surface 369 configured with undulations or grooves 370. The presence of the grooves 370 may facilitate improved (sliding/moving) engagement between the ring 323 and the cone 314. In embodiments, a friction reducer (such as grease) or the like may be disposed within the grooves 370.

Figure 4A:
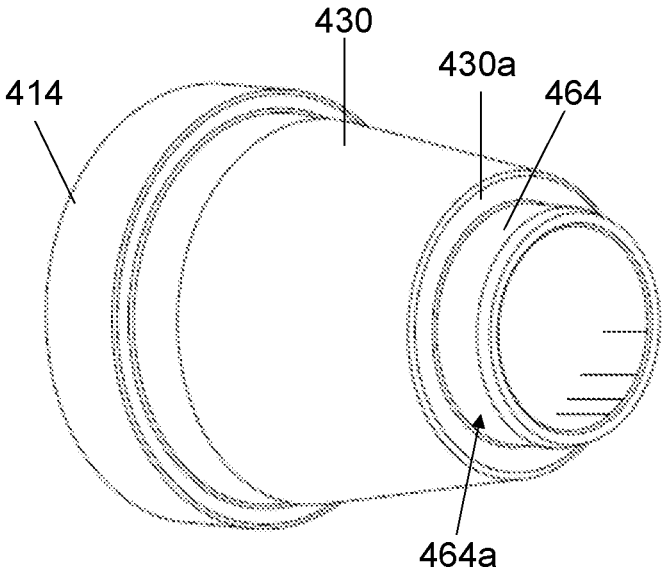
FIG. 4A shows an isometric front view of a cone for use with a downhole tool, according to embodiments of the disclosure.
Figure 4B:
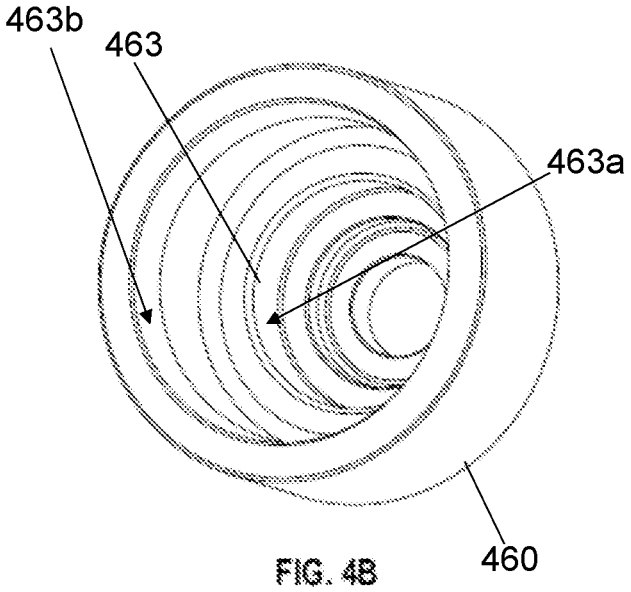
FIG. 4B shows an isometric rear view of a lower sleeve for use with a downhole tool, according to embodiments of the disclosure.

Referring now to FIGS. 4A and 4B together, an isometric front view of a cone for use with a downhole tool, and an isometric rear view of a lower sleeve for use with a downhole tool, respectively, according to embodiments of the disclosure, are shown. One of skill would appreciate the views of FIGS. 4A and 4B may be partial in nature.

FIGS. 4A and 4B show a downhole tool of embodiments herein may include a cone 414 and a lower sleeve 460. These components, while part of a downhole tool, need not be engaged, such as in a run-in configuration of a workstring. The cone 414 and lower sleeve 460 may be configured for operation with a setting tool assembly. When the cone 414 is arranged around a tension mandrel (e.g., 316), a cone outer surface 430 may have one or more components disposed therearound. The cone outer surface 430 may terminate at a shoulder end 430*a*; however, the cone 414 may have a cone tip 464 extend therefrom. The cone tip 464 may have a cone tip outer surface 464*a*.

In an analogous manner, the lower sleeve 460 may have an inner sleeve body configured with one or more annular ridges or recesses, such as recess or groove 463. In inner sleeve recess surface 463*a* may be configured to engage the cone tip outer surface 464*a* (see by way of example, first contact point 366, FIG. 3B).

The lower sleeve 460 may have another sleeve surface 463*b* configured to engage the cone 414. For example, the another sleeve surface 463*b* may engage the cone outer surface 430 (see by way of example, second contact point 367, FIG. 3B).

Upon activation, compression force generated by the setting tool may urge the expansion ring up/against the ramped or angled surface 430 of the cone 414 via the lower sleeve 460 until the sleeve locates on or proximate shoulder end 430*a*. Or until the cone tip 464 extends all the way into the recess 463. After shearing and setting, the cone tip 464 remains engaged against the recess 463 via interference or tolerance fit.

Advantages

Embodiments of the downhole tool are smaller in size, which allows the tool to be used in slimmer bore diameters. Smaller in size also means there is a lower material cost per tool. Because isolation tools, such as plugs, are used in vast numbers, and are generally not reusable, a small cost savings per tool results in enormous annual capital cost savings.

When downhole operations run about $30,000-$40,000 per hour, a savings measured in minutes (albeit repeated in scale) is of significance.

A synergistic effect is realized because a smaller tool means faster drilling time is easily achieved. Again, even a small savings in drill-through time per single tool results in an enormous savings on an annual basis.

As the tool may be smaller (shorter), the tool may navigate shorter radius bends in well tubulars without hanging up and presetting. Passage through shorter tool has lower hydraulic resistance and can therefore accommodate higher fluid flow rates at lower pressure drop. The tool may accommodate a larger pressure spike (ball spike) when the ball seats.

While preferred embodiments of the disclosure have been shown and described, modifications thereof can be made by one skilled in the art without departing from the spirit and teachings of the disclosure. The embodiments described herein are exemplary only, and are not intended to be limiting. Many variations and modifications of the disclosure disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A downhole tool for use in a wellbore, the downhole tool comprising:

a cone comprising:

a distal end; a proximate end; and an outer surface, an expansion sleeve slidingly engaged with the outer surface; and a lower sleeve proximate with the expansion sleeve, wherein in a run-in configuration the cone is not engaged with the lower sleeve, but after setting the downhole tool to a set configuration, the cone is engaged with the lower sleeve, wherein the lower sleeve comprises an inner recess configured to provide an interference or tolerance fit with a cone tip end when the downhole tool is in the set configuration, and wherein setting of the downhole tool to the set configuration results in expansion of the expansion sleeve, but the downhole tool remains free to move or be moved to engage a profile of a surrounding tubular in the wellbore.

2. The downhole tool of claim 1, wherein the set configuration the downhole tool forms a plug in support of a fracturing operation once a ball is seated in the cone.

3. The downhole tool of claim 1, wherein the profile comprises a pre-existing restriction.

4. The downhole tool of claim 1, wherein an inner flowbore of the cone comprises an inner diameter in a bore range of at least 1 inch to no more than 5 inches, and wherein the lower sleeve comprises a shear tab.

5. The downhole tool of claim 1, wherein the lower sleeve comprises a shear tab, wherein at least one component of the downhole tool is made of a dissolvable material, and wherein the cone further comprises a ball seat formed within an inner flowbore.

6. The downhole tool of claim 1, wherein at least one component of the downhole tool is made of a dissolvable material, and wherein the cone further comprises a ball seat formed within an inner flowbore.

7. The downhole tool of claim 1, wherein the lower sleeve comprises a one-piece, non-segmented body.

8. A downhole setting system for use in a wellbore, the system comprising:

a workstring;

a setting tool assembly coupled to the workstring, the setting tool assembly further comprising:

a tension mandrel comprising a first tension mandrel end and a second tension mandrel end; and a setting sleeve;

a downhole tool comprising:

a cone comprising:

a distal end; a proximate end; and an outer surface, an expansion sleeve engaged with the outer surface; and a lower sleeve proximate the expansion sleeve, and coupled with the tension mandrel, wherein in a run-in configuration the tension mandrel is disposed through the downhole tool, and a nose nut is engaged with each of the second tension mandrel end and the lower sleeve, wherein the lower sleeve comprises an inner recess configured to provide an interference or tolerance fit with a cone tip end of the cone when the downhole tool is moved to a set configuration, and wherein the set configuration comprises the lower sleeve engaged with the cone at a first contact point and a second contact point, and a clearance gap between the first contact point and the second contact point.

9. The downhole setting system of claim 8, wherein setting of the downhole tool to the set configuration results in expansion of the expansion sleeve, but the downhole tool remains free to move or be moved to engage a profile of a surrounding tubular in the wellbore.

10. The downhole setting system of claim 9, wherein at least one component of the downhole tool is made of a dissolvable material, and wherein the cone further comprises a ball seat formed within an inner flowbore.

11. The downhole setting system of claim 8, wherein activation of the downhole tool to the set configuration in the wellbore results in expansion of the expansion sleeve, but the downhole tool is not anchored against a side of a tubular.

12. The downhole setting system of claim 11, wherein the tubular comprises a tubular sub engaged with a restriction sub, wherein a side of the tubular sub comprises a side inner diameter, wherein the restriction sub comprises a profile having a restriction inner diameter, and wherein the side inner diameter is larger than the restriction inner diameter.

13. The downhole setting system of claim 12, wherein after activation, the downhole tool is configured to move or be moved to seat on the profile, and thereby form a plug in support of a fracturing operation once a ball is seated in the downhole tool.

14. The downhole setting system of claim 12, wherein in the run-in configuration the downhole tool has a tool outer diameter smaller than the restriction inner diameter, wherein in the set configuration the tool outer diameter is larger than the restriction inner diameter.

15. A method of using a downhole tool in a wellbore, the method comprising:

running the downhole tool in a run-in configuration to a position within a tubular disposed within the wellbore;

activating a setting tool assembly to move the downhole tool from the run-in configuration to a set configuration;

causing the downhole tool and the setting tool assembly to disconnect from each other, wherein the downhole tool comprises: a cone; an expansion sleeve slidingly engaged with the cone; and a lower sleeve proximate with the expansion sleeve, wherein in the set configuration, the downhole tool is not anchored against the tubular, wherein activation of the downhole tool in the wellbore results in expansion of the expansion sleeve, wherein the tubular comprises a tubular sub engaged with a restriction sub, wherein a side of the tubular sub comprises a side inner diameter, wherein the restriction sub comprises the profile having a restriction inner diameter, wherein the side inner diameter is larger than the restriction inner diameter, wherein the lower sleeve comprises a one-piece, non-segmented body, and wherein the set configuration comprises the lower sleeve engaged with the cone at a first contact point and a second contact point, and a clearance gap between the first contact point and the second contact point.

16. The method of claim 15, wherein the downhole tool form a plug in support of a fracturing operation once a ball is seated in the cone, and wherein at least one component of the downhole tool is made of a dissolvable material.

17. The downhole setting system of claim 15, wherein the lower sleeve comprises a shear tab.

18. A method of using a downhole tool in a wellbore, the method comprising:

running the downhole tool in a run-in configuration to a position within a tubular disposed within the wellbore;

activating a setting tool assembly to move the downhole tool from the run-in configuration to a set configuration;

causing the downhole tool and the setting tool assembly to disconnect from each other, wherein the downhole tool comprises: a cone having an inner flowbore; an expansion sleeve slidingly engaged with the cone; and a lower sleeve proximate with the expansion sleeve, wherein in the set configuration, the downhole tool is not anchored against a sidewall of the tubular, wherein the tubular comprises a tubular sub configured with a profile, wherein in the run-in configuration the lower sleeve is not in direct contact with the cone, wherein the lower sleeve comprises an inner recess configured for engagement with a cone tip end of the cone when the downhole tool is in the set configuration, and wherein the cone further comprises a ball seat formed within the inner flowbore of the cone.

* * * * *